US005453038A

United States Patent [19]

Baumann

[11] Patent Number: 5,453,038

[45] Date of Patent: Sep. 26, 1995

[54] METHOD AND APPARATUS FOR FINISHING MACHINED ORIFICES IN CERAMICS

[76] Inventor: Richard N. Baumann, 56 Hillcrest Ave., Washington, N.J. 07882

[21] Appl. No.: 271,068

[22] Filed: Jul. 5, 1994

[51] Int. Cl.[6] ..... B24B 1/00

[52] U.S. Cl. ..... 451/28; 451/556

[58] Field of Search ..... 451/28, 61, 58, 451/57, 51, 162, 163, 164, 170, 176, 440, 556

[56] References Cited

U.S. PATENT DOCUMENTS

| | | | |
|---|---|---|---|
| 93,091 | 7/169 | Jenkins | 451/556 |
| 1,960,706 | 11/1932 | Liermann | 451/556 |
| 2,571,324 | 12/1947 | Young | 451/51 |
| 3,728,145 | 4/1973 | Hjerten | 451/51 |
| 5,140,773 | 8/1992 | Miwa et al. | 51/59 |

*Primary Examiner*—Bruce M. Kisliuk
*Assistant Examiner*—Derris H. Banks
*Attorney, Agent, or Firm*—Kenneth P. Glynn

[57] ABSTRACT

The present invention is directed at a method and an apparatus for finishing an orifice surface of a work piece consisting of a hard material such as ceramics or glass. The method removes surface anomalies on the orifice surface with a broach to produce a finished orifice. The broach tapers from a broad end down to a narrow end. The cross-section at the broad end is sized to fit snugly in the finished orifice. The method involves inserting the narrow end of the broach through an orifice of the work piece, and passing the broach through the orifice. In this way, the broach files and thereby removes the surface anomalies to conform the orifice to the finished orifice.

18 Claims, 7 Drawing Sheets

METHOD AND APPARATUS FOR FINISHING MACHINED ORIFICES IN CERAMICS

BACKGROUND OF THE INTENTION

1. Field of the Invention

The invention relates generally to a method and device for machining hard materials such as ceramics and glass, and more specifically to the use of a special broach for smoothing an orifice surface of a work piece consisting of a hard material.

2. Information Disclosure Statement

The method and devices for machining orifices into hard materials such as ceramics and glass are well known in the art. Perhaps the most common method involves ultra-sound machining. As discussed in U.S. Pat. No. 5,140,773, ultrasonic machine tools conventionally have a machining head connected to a piezoelectric transducer and a grindstone such as a diamond for boring or polishing. In operation, the machine head is rotated by a motor while the piezoelectric transducer ultrasonically vibrates. The top of the tool is then pressed into the work. The piezoelectric transducer causes the tool to vibrate axially and radially on the surface of the work thereby boring it.

The vibrating nature of this boring process creates surface anomalies on the orifice surface. Moreover, in the conventional method of ultrasonic machining, the rigidity of the tool is very low when its diameter is small (for example, less than 1 mm). Lacking rigidity, the tip of the tool tends to bend and slide at the initial stage of the machining when no guide hole is yet formed. Consequently, the tip makes an eccentric rotation on the surface of the work without making a bore. This eccentric rotation adds to the surface anomalies created in ultrasonic machining.

U.S. Pat. No. 5,140,773 offers an improved method and device for making such bores. This patent discloses a method and apparatus for reducing the eccentric rotations present in the initial stages of machining. Although this improves the quality of the orifice surface, the surface anomalies inherent in ultrasonic machining remain.

The traditional method of removing these surface anomalies is to hand file them. To hand finish an orifice surface, the hard work piece is placed under a microscope and a person uses a small file to smooth the anomalies one at a time. This process is extremely tedious, time consuming, and subject to human error and inconsistency. A need therefore exists to remove these surface anomalies in a systematic and expedient manner. The present invention fulfills this need.

SUMMARY OF THE INVENTION

The present invention is directed at a method and an apparatus for finishing an orifice surface of a work piece consisting of a hard material such as ceramics or glass. The method removes surface anomalies on the orifice surface with a broach to produce a finished orifice. The broach tapers from a broad end down to a narrow end. The cross-section at the broad end is sized to fit snugly in the finished orifice. The method involves inserting the narrow end of the broach through an orifice of the work piece, and passing the broach through the orifice. In this way, the broach files and thereby removes the surface anomalies to conform the orifice to the finished orifice.

BRIEF DESCRIPTION OF THE DRAWINGS

The features of the present invention, which are believed to be novel, are set forth with particularity in the appended claims. The invention may best be understood by reference to the following description taken in conjunction with the accompanying drawings, wherein like reference numerals identify like elements, and wherein:

DETAILED DESCRIPTION OF THE PRESENT INVENTION

The present invention is directed at a method for finishing an orifice surface of a work piece consisting of a hard material such as ceramics or glass. The invention is also directed at an apparatus used to perform the method, and at a hard work piece having a highly finished orifice as produced from the present method.

Figure 1:
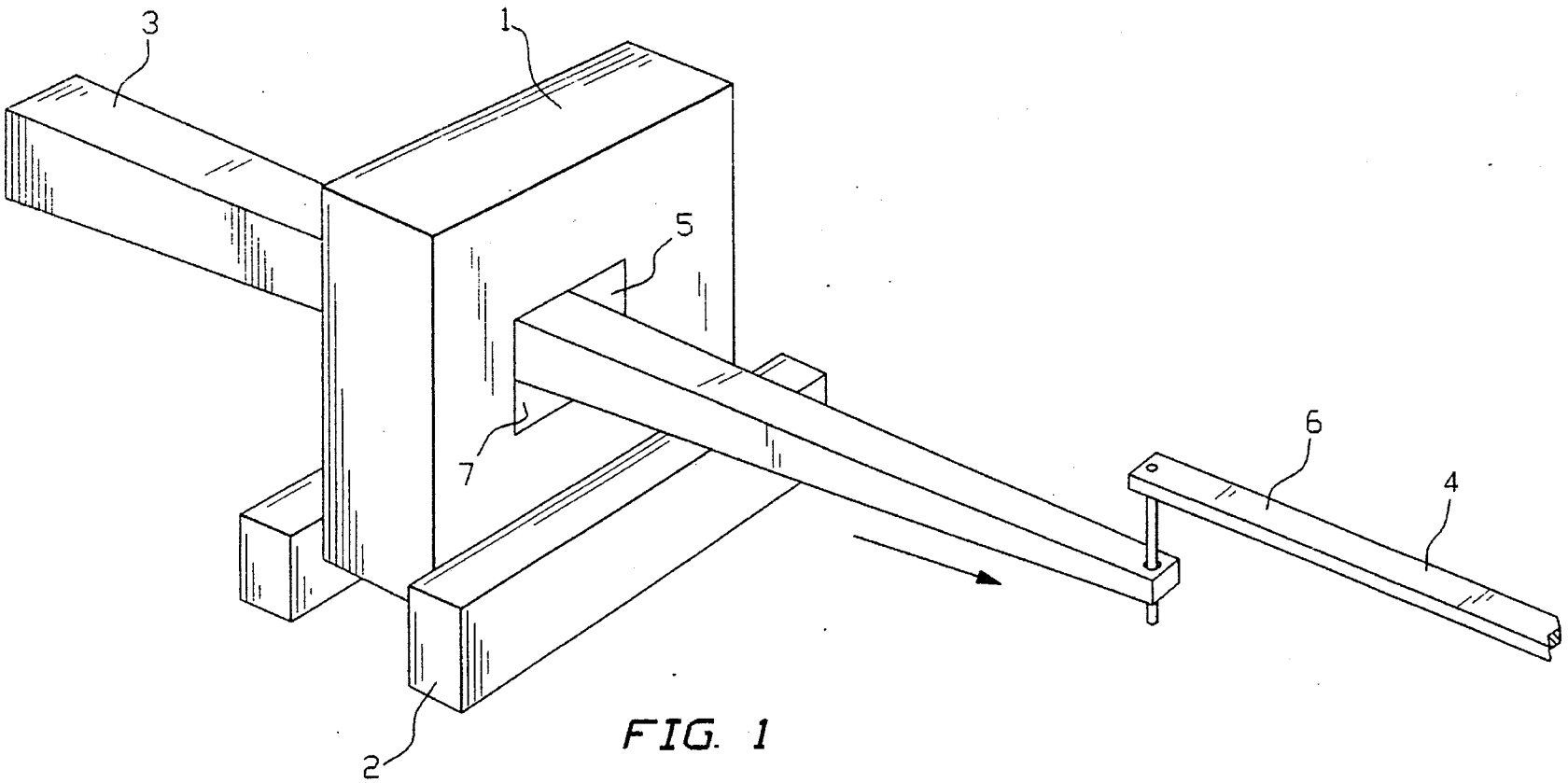
FIG. 1 shows a general schematic of the apparatus used to finish an orifice surface in a hard work piece.

The apparatus comprises several components as schematically depicted in FIG. 1. That figure shows a hard work piece 1 having an orifice 7 and an orifice surface 5, a securing means 2, a broach 3, an attaching means 6, and a moving means 4. Hard work piece 1 can consist of any hard material such as ceramics, glass, poly-crystals, metals, and cement.

Figure 2B:
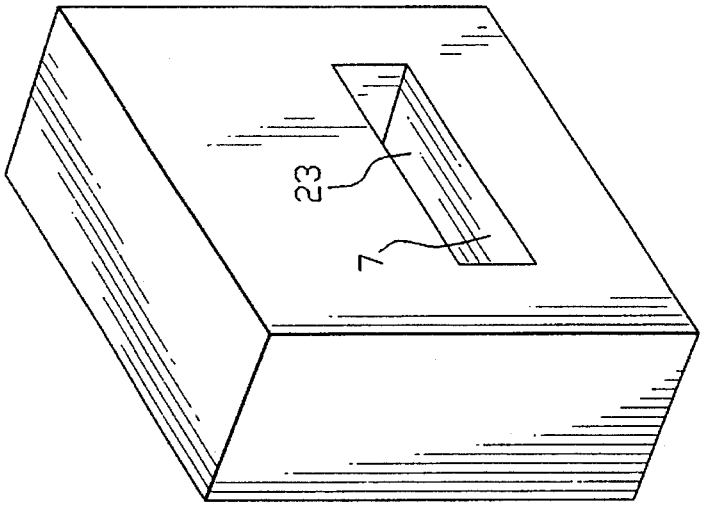
FIGS. 2*a* and 2*b* show an orifice of a hard work piece before (2*a*) and after (2*b*) its finishing.
Figure 2C:
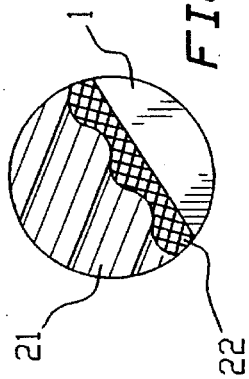
FIG. 2*c*shows a blow-up of an unfinished surface of FIG. 2*a*.
Figure 2A:
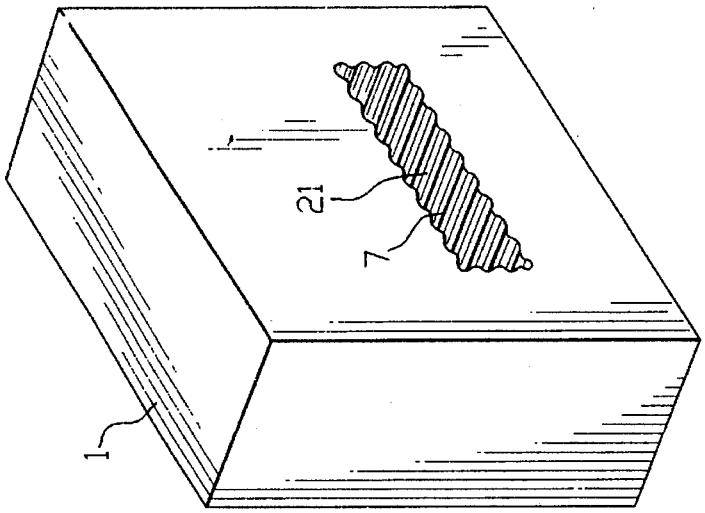

An example of the orifice surface is shown in FIGS. 2*a* and 2*b*. FIG. 2*a* shows a rough orifice surface 21 which results from traditional machining processes such as ultrasonic or laser boring. As the detail of FIG. 2*a* shows, rough orifice surface 21 contains surface anomalies 22 which need to be removed to obtain a smooth surface. The shaded portion of the figure indicates those surface anomalies 22 which require removal. The broach is designed to file down such surface anomalies as it passes through orifice 7. FIG. 2*b* shows the same hard work piece 1 with a finished orifice surface 23 after the broach has passed. Thus, the method and apparatus serve to smooth the orifice surface.

By virtue of its abrasiveness and shape, the broach effectively files down surface anomalies as it passes through the orifice. Broach 31, as depicted in FIG. 3, is an elongated article consisting of a rigid material such as a metal or a hard plastic. It is impregnated with an abrasive material 35 in a process such as diamond plating.

Figure 3A:
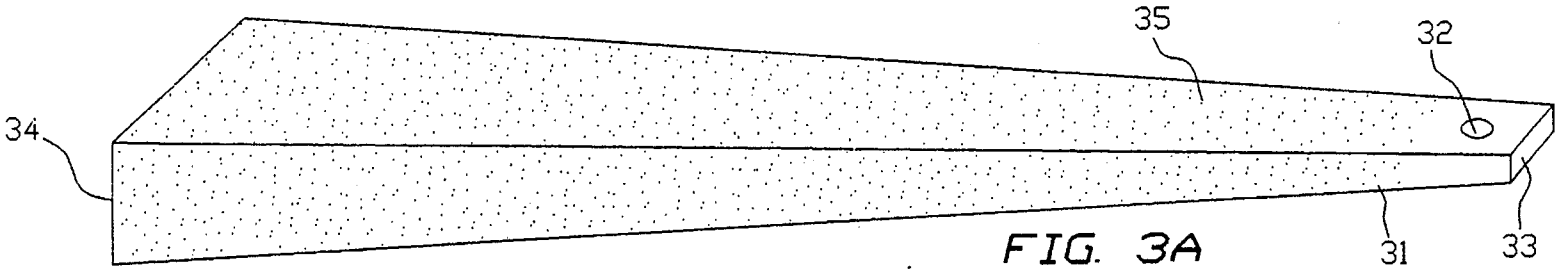
FIGS. 3*a*, 3*b*, and 3*c* show different embodiments of the broaches used in the finishing process, and 3*d* is a plot of a linear slope.
Figure 3B:
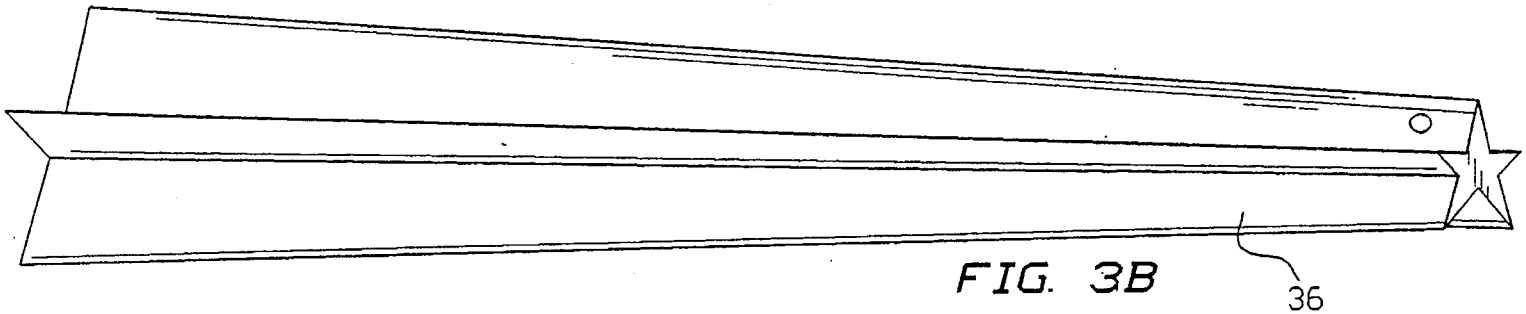
Figure 3C:
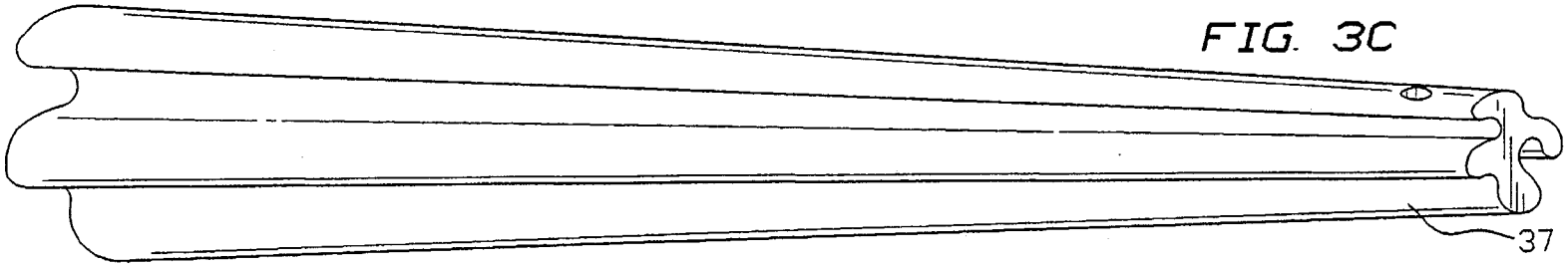
Figure 4A:
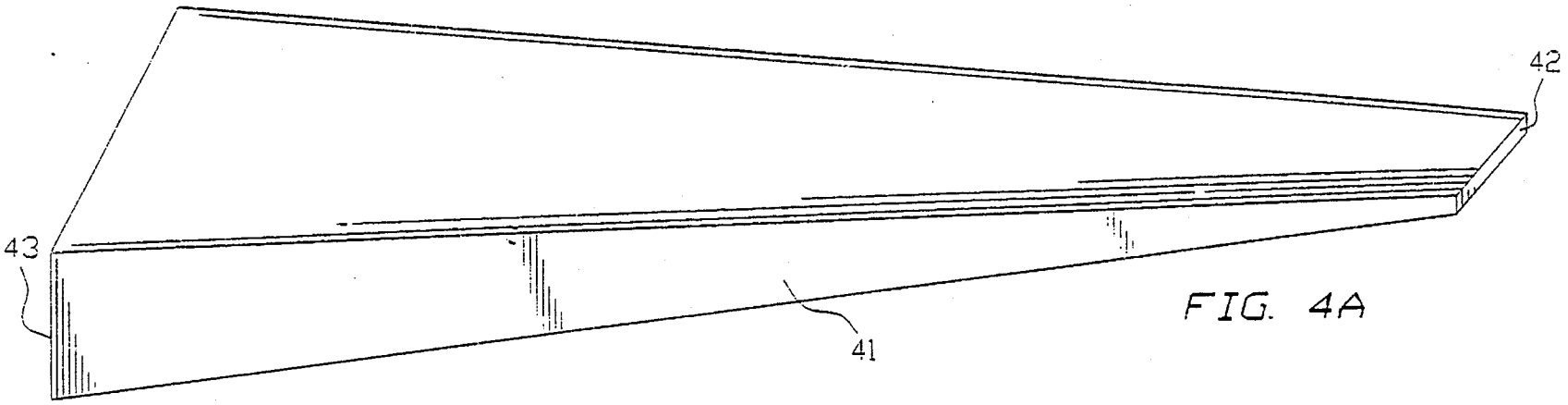
FIG. 4*a* shows an alternate embodiment of the broach having a hyperbolic slope, and 4*b* shows a plot of this slope.
Figure 4B:
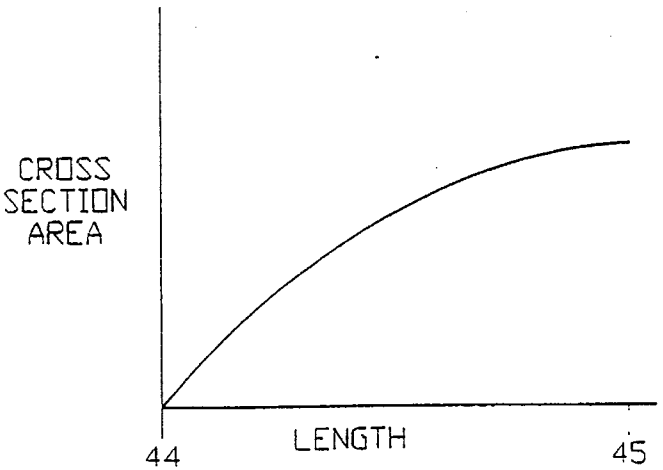
Figure 3D:
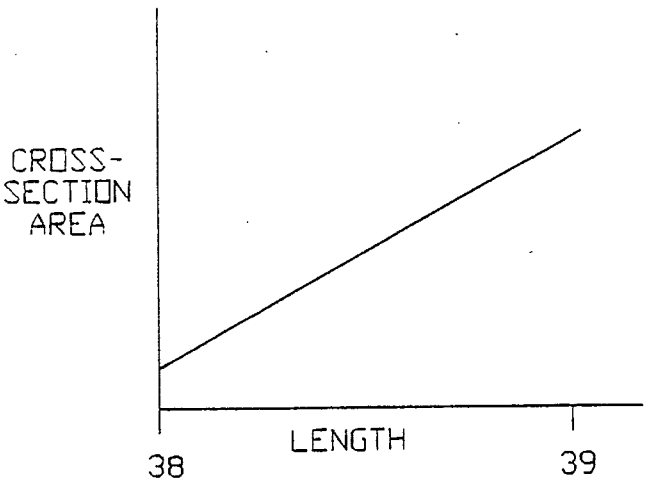

The broach is further characterized by a taper from a broad end 34 down to a narrow end 33. The narrow end has dimensions small enough to fit within an orifice having a rough surface. As the broach passes through the orifice, the surface anomalies in contact with the broach are filed away. The broach maintains this filing action as it is pulled through the orifice by increasing in cross-sectional area and thereby constantly expanding into the orifice surface. In FIGS. 3*a*, 3*b*, and 3*c*, this taper is linear as shown in FIG. 3*d* wherein position 38 represents narrow end 33 and position 39 denotes broad end 34. A preferred embodiment of this taper is a slope (i.e., rise over run) of 0.0002 or less. Such a gentle slope will ensure a slow, fine filing of the rough orifice surface. A greater slope may file the orifice too aggressively and result in problems such as chipping the ceramic, binding the broach, or ruining the broach. In another preferred embodiment, the slope of the taper is not linear but rather hyperbolic. Broach 41 in FIG. 4*a* depicts such a hyperbolic configuration. It has a steep slope near its narrow end 42 but it decreases towards the broader end 43. A corresponding plot of the slope is given in FIG. 4*b*. The slope of broach 41 aggressively files the surface anomalies at its narrow end where a relatively small amount of the broach contacts the orifice surface. However, the filling becomes less aggressive towards the broader end where greater contact between the orifice surface and the broach occurs.

The cross-sectional shape of the broach can assume several different embodiments as shown in FIGS. 3*a*, 3*b*, and 3*c*. FIG. 3*a* shows broach 31 with a rectangular cross-section which is used for finishing a slot in a hard work piece. However, as FIGS. 3*b* and 3*c* show, other cross-sections are possible. A star-shaped broach 32 of FIG. 3*b* demonstrates a complicated polygon design, while an irregular broach 32 of FIG. 3*c* shows an irregular cross-section.

Figure 7A:
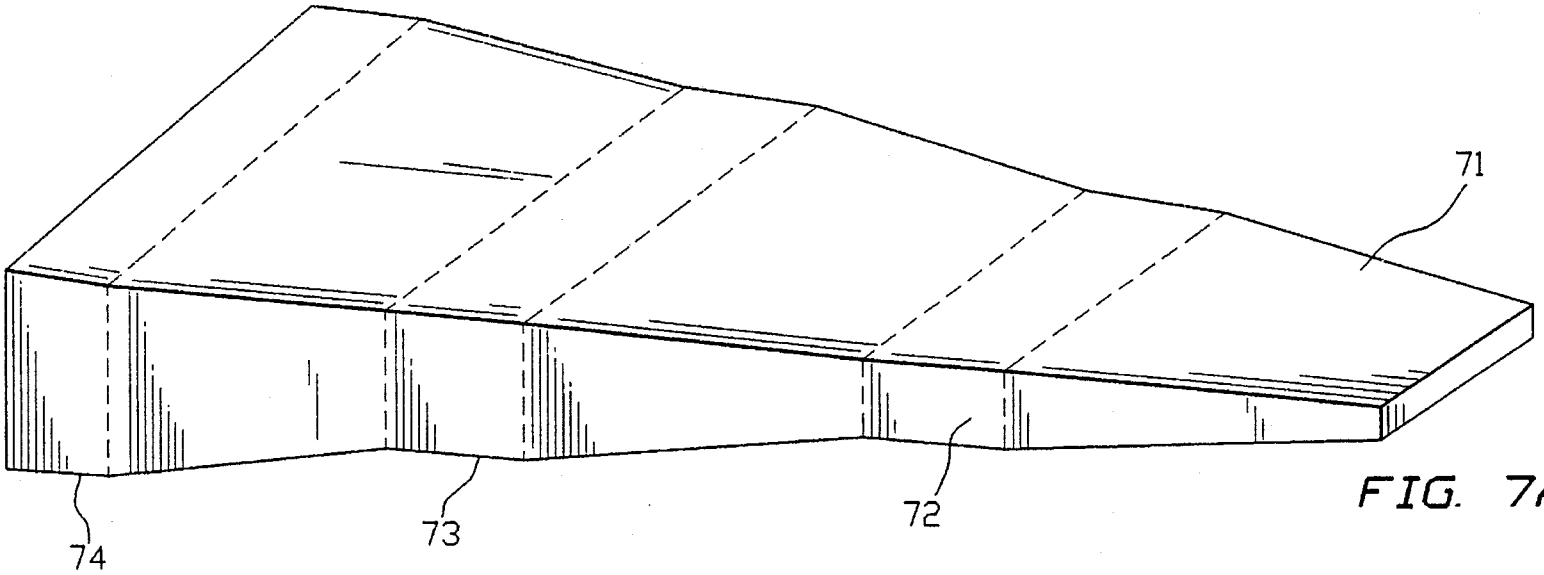
FIG. 7*a* show a broach with non-tapered portions, and 7*b* shows a plot of this taper.
Figure 7B:
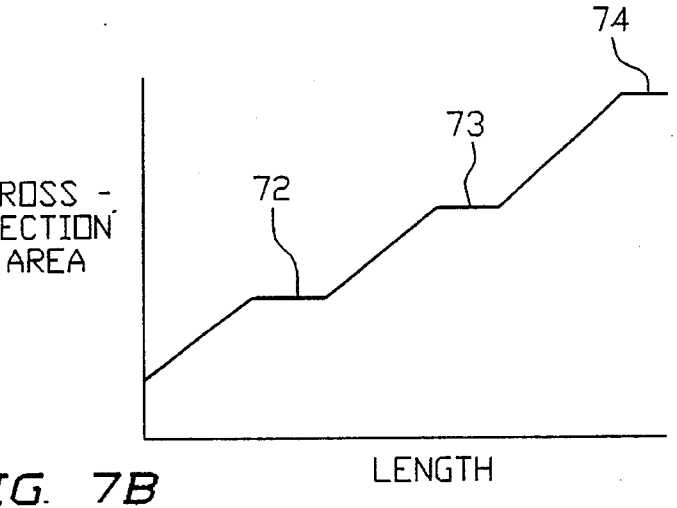

In one embodiment, the cross-section of the broad end of the broach is sized to fit snugly inside of the desired finished orifice such that the entire orifice surface contacts the broad end of the broach. This embodiment requires that the entire broach be pulled through the orifice to finish it. In an alternate embodiment shown in FIG. 7*a*, broach 71 is calibrated at particular points 72, 73, and 74 along its length. Each calibration corresponds to a particular broach cross-section for producing a desired finished orifice. This embodiment enables a single broach to finish orifices of various size. The broach can be further refined to have non-tapered portions at points 72, 73, and 74 as illustrated in FIG. 7*a* and plotted in FIG. 7*b*. The length of these non-tapered portions should approximate the length of the orifice surface such that the entire surface can be exposed to the same cross-sectional area of broach 71. This eliminates a taper in the orifice surface and produces a uniform finished orifice having the same cross-sectional area throughout.

As shown in FIG. 1, hard work piece 1 and broach 3 are held by securing means 2 and attaching means 6 respectively. These means can be any traditional means for holding an object steady which includes a vice, pegs, pins, fasteners, a suction device, magnetics, and glue.

Figure 5:
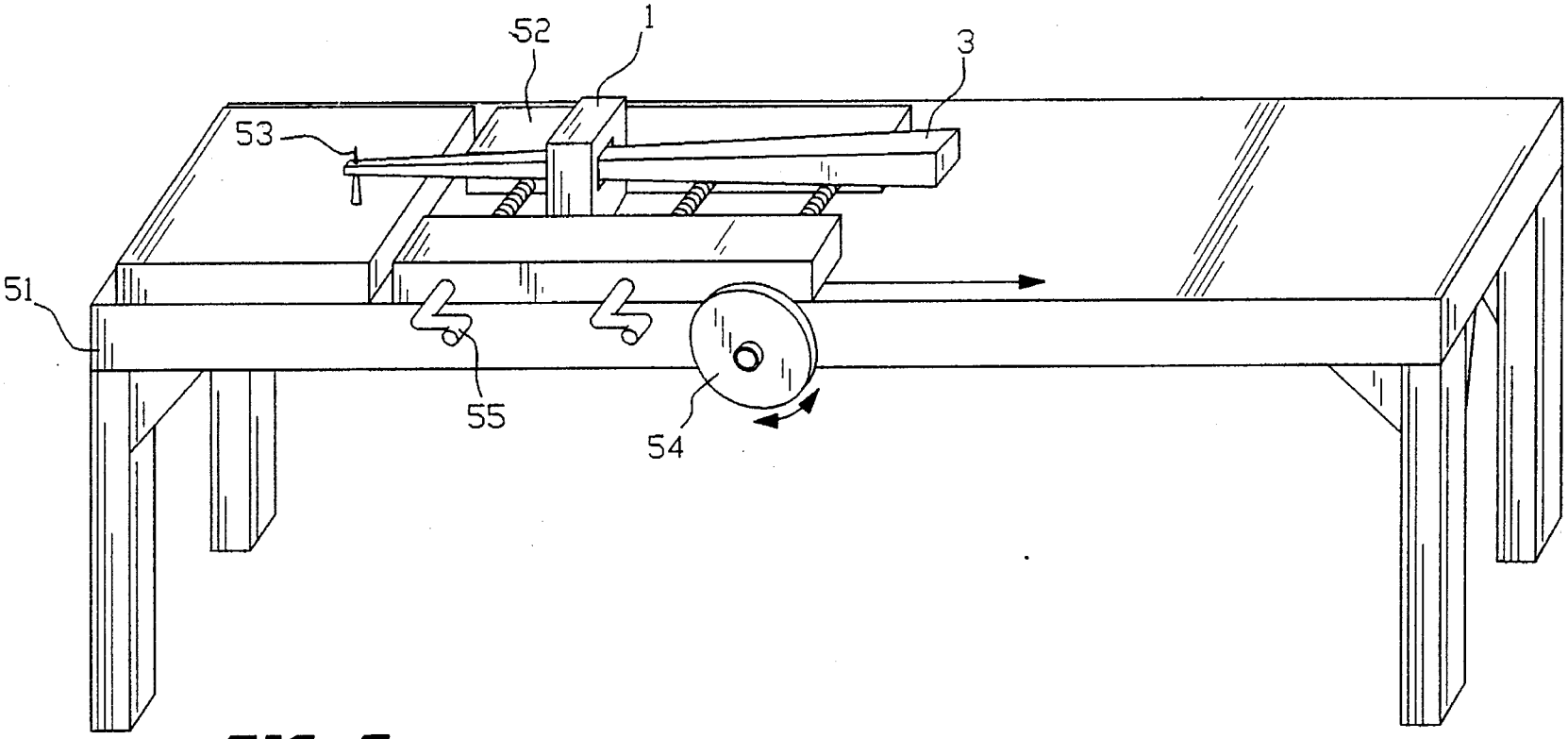
FIG. 5 shows an embodiment of the finishing tool wherein the broach is held stationary and the hard work piece is moved.

Moving means 4 assumes several different embodiments, however, it basically functions to move hard work piece 1 and broach 3 in relation to each other. For example, in one preferred embodiment, a modified milling machine is used as shown in FIG. 5. Here, securing means 55 is a vice mounted on a movable table 52. Attaching means 53—which comprises a pin assembly in this embodiment—passes through a pulling hole 32 of broach 3, and is secured to a stationary portion of milling machine 51. To pull the broach through hard work piece 1, the operator simply turns a hand crank 54 which moves table 52. This action moves securing means 3 relative to attaching means 53 which in effect moves hard work piece 1 relative to broach 3. In this configuration, table 52 and hand crank 54 constitute the moving means.

Figure 6:
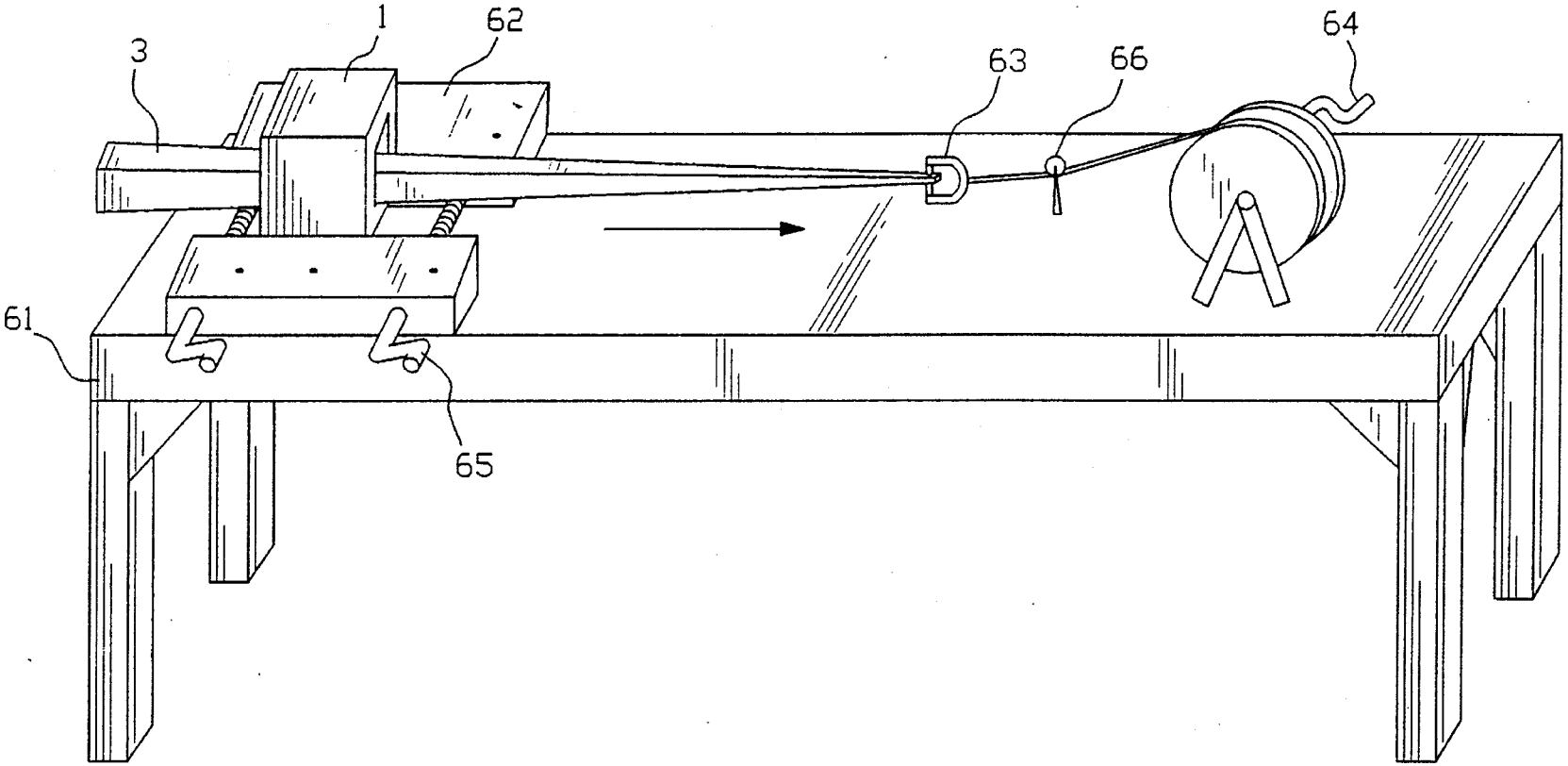
FIG. 6 shows an alternate embodiment of the finishing tool wherein the hard work piece is held stationary and the broach is moved.

An alternative embodiment of the moving means is depicted in FIG. 6. Here, hard work piece 1 is kept stationary while broach 3 is pulled through the orifice. This particular embodiment uses a hand operated winch 64 to effect the pulling, and a guide 66 to ensure that the pulling is essentially parallel to the orifice surface. Winch 64 is operatively connected to attaching means 63 which in turn fastens to broach 3. Hard work piece 1 is held stationary via securing means 65 and 62 which comprises a vice mounted to a bench 61. In addition to these configurations, it should be noted that many different embodiments of the moving means are possible providing that hard work piece 1 and broach 3 are moved in relation to each other. However, because the broach is typically thin and brittle, it is preferred—although not required—to pull the broach through the orifice rather than push it. Pulling the broach avoids torsional and normal forces on the broach, and utilizes the broach's relatively high tensile strength.

It should also be noted that the apparatus can be oriented in any direction. Although the embodiments discussed thus far depict a horizontal configuration, a vertical orientation is also possible. In fact, pulling the broach vertically through the orifice eliminates the effect gravity has on the portion of the orifice surface which supports the broach. A vertical pull would therefore file the orifice surface more evenly.

Obviously, numerous modifications and variations of the present invention are possible in the light of the above teachings. It is therefore understood that within the scope of the appended claims, the invention may be practiced otherwise than as specifically described herein.

What is claimed is:

1. A method of finishing an orifice surface of a hard work piece, said method removes surface anomalies on said orifice surface with a broach to produce a finished orifice, said broach tapers from a broad end down to a narrow end, said method comprises:

a. inserting said narrow end of said broach through an orifice of said hard work piece; and b. passing said broach through said orifice, said broach has a cross-section sized to fit snugly in said finished orifice such that passing said broach through said orifice files and thereby removes said surface anomalies to conform said orifice to said finished orifice.

2. The method of claim 1, wherein step b further comprises passing said broach through said orifice by pulling said narrow end using a moving means; and said method further comprises:

c. securing said hard work piece using a securing means;

d. attaching said narrow end of said broach to an attaching means; and e. aligning said broach in said orifice such that said broach is substantially parallel to said orifice surface.

3. The method of claim 2 wherein step b. further comprises pulling said broach completely through said orifice such that said broad end passes through said orifice thereby finishing said finished orifice to the size of said broad end.

4. The method of claim 2 wherein step b. further comprises pulling said broach such that a certain cross-sectional area of said broach passes through said orifice, said certain cross-sectional area is sized to fit snugly in said finished orifice thereby finishing said orifice to said finished orifice.

5. A hard work piece having an orifice finished in accordance with the process of claim 1.

6. A tool for finishing an orifice surface of a hard work piece, said tool removes surface anomalies on said orifice surface to produce a finished orifice, said tool comprises a broach having a narrow end and a broad end, said broach has a taper from said broad end down to said narrow end, said narrow end has a cross-sectional area small enough to fit within an orifice of said hard work piece, said broad end has a cross-sectional area sufficient to fit snugly in said finished orifice, said broach comprises a rigid material embedded with an abrasive material harder than said hard work piece.

7. The tool of claim 6 wherein said abrasive material comprises diamonds.

8. The tool of claim 6 wherein said taper is linear.

9. The tool of claim 8 wherein said taper has a slope no greater than 0.0002.

10. The tool of claim 6 wherein said taper is hyperbolic.

11. The tool of claim 6 wherein said broach contains a pulling hole at said narrow end, said pulling hole facilitates the pulling of said broach through said orifice.

12. An apparatus for finishing an orifice surface of a hard work piece, said apparatus removes surface anomalies on said orifice surface to produce a finished orifice, said apparatus comprises:

a. a broach having a narrow end and a broad end, said broach has a taper from said broad end down to said narrow end, said narrow end has a cross-sectional area small enough to fit within an orifice of said hard work piece, said broad end has a cross-sectional area sufficient to fit snugly in said finished orifice, said broach comprises a rigid material embedded with an abrasive material harder than said hard work piece;

b. securing means for holding said hard work piece;

c. attaching means for holding said broach;

d. moving means for moving said securing means and said attaching means in relation to each other and thereby passing said broach through said orifice.

13. The apparatus of claim 12 wherein said abrasive material comprises diamonds.

14. The apparatus of claim 12 wherein said broach contains a pulling hole at said narrow end, said pulling hole is adapted to receive said attaching means.

15. The apparatus of claim 12 wherein said moving means operatively connects to said securing means such that said moving means moves said securing means while said broach is held stationary thereby pulling said broach through said orifice.

16. The apparatus of claim 15 wherein said moving means comprises a hand operated movable table on a milling machine; wherein said securing means comprises a vice on said movable table; and wherein said attaching means comprises a stationary pin assembly mounted to said milling machine.

17. The apparatus of claim 12 wherein said moving means operatively connects to said attaching means such that said moving means moves said attaching means while said hard work piece remains stationary thereby pulling said broach through said orifice.

18. The apparatus of claim 14 wherein said securing means and said attaching means are oriented vertically such that said broach and said article move in a vertical direction relative to each other.

* * * * *